US009532669B2

(12) United States Patent
Schoeler et al.

(10) Patent No.: US 9,532,669 B2
(45) **Date of Patent: *Jan. 3, 2017**

(54) ROTATABLE DISPLAY

(71) Applicant: The Unicover Corporation, Cheyenne, WY (US)

(72) Inventors: Larry Schoeler, Cheyenne, WY (US); Cheryl Mefford, Cheyenne, WY (US); Thomas Eric Delaplaine, Cheyenne, WY (US); Debra Zoe Seemel, Cheyenne, WY (US); Katherine Clark Helzer, Chicago, IL (US)

(73) Assignee: The Unicover Corporation, Cheyenne, WY (US)

( * ) Notice: Subject to any disclaimer, the term of this patent is extended or adjusted under 35 U.S.C. 154(b) by 5 days.

This patent is subject to a terminal disclaimer.

(21) Appl. No.: 14/515,801

(22) Filed: Oct. 16, 2014

(65) Prior Publication Data

US 2016/0007772 A1 Jan. 14, 2016

Related U.S. Application Data

(63) Continuation-in-part of application No. 14/327,848, filed on Jul. 10, 2014.

(51) Int. Cl.
*A45C 1/00* (2006.01)
*A47G 1/12* (2006.01)
(Continued)

(52) U.S. Cl.
CPC . *A47G 1/12* (2013.01); *A47F 7/02* (2013.01); *B65D 25/10* (2013.01); *B65D 25/54* (2013.01); *B65D 43/02* (2013.01); *B65D 85/58* (2013.01)

(58) Field of Classification Search
CPC ... A45C 2001/028; B65D 73/00; B65D 25/10; B65D 25/54; B65D 43/02; B65D 85/58; G07D 9/002; G07D 11/0096; A47G 1/12; A47F 7/02
(Continued)

(56) References Cited

U.S. PATENT DOCUMENTS 2,129,879 A 9/1938 Samuel
2,258,535 A 10/1941 Buranclli
(Continued)

FOREIGN PATENT DOCUMENTS

DE 201 15 534 U1 1/2002
DE 202 00 976 5/2002
(Continued)

OTHER PUBLICATIONS

International Search Report and Written Opinion for Int'l Application No. PCT/US2015/039548, titled: Rotatable Display, Date Mailed: Oct. 14, 2015.

*Primary Examiner* — Jacob K Ackun
*Assistant Examiner* — Rafael Ortiz
(74) *Attorney, Agent, or Firm* — Hamilton, Brook, Smith & Reynolds, P.C.

(57) ABSTRACT

A rotatable display for containing an article including a coin. The rotatable display can include an article receptacle for holding the article, which can be easily rotated by a user. The article receptacle can have an outer flange. A display panel can rotatably capture the article receptacle. The display panel can include a first display layer and an annular retaining structure mounted to the first display layer rotatably capturing the outer flange of the article receptacle against the first display layer. The annular retaining structure can be deflectable against the outer flange. The annular retaining structure can have a smooth slippery surface, and
(Continued)

can be configured for deflecting away from the first display layer and to facilitate rotation of the outer flange and the article receptacle relative to the display panel.

9 Claims, 11 Drawing Sheets

(51) Int. Cl.

| | |
|---|---|
| ***B65D 25/10*** | (2006.01) |
| ***B65D 25/54*** | (2006.01) |
| ***B65D 43/02*** | (2006.01) |
| ***B65D 85/58*** | (2006.01) |
| ***A47F 7/02*** | (2006.01) |

(58) Field of Classification Search
USPC ..... 206/0.8, 0.81, 0.83, 0.84, 538, 462, 467,206/471
See application file for complete search history.

(56) References Cited

U.S. PATENT DOCUMENTS

| | | | | |
|---|---|---|---|---|
| 2,457,998 | A | 1/1949 | Hayes et al. | |
| 2,597,227 | A | 5/1952 | Colliton | |
| 2,899,046 | A | 8/1959 | Cox, Jr. | |
| 2,971,638 | A | 2/1961 | Allison et al. | |
| 3,025,952 | A | 3/1962 | Phipps | |
| 3,100,567 | A | 8/1963 | Levy | |
| 3,139,977 | A * | 7/1964 | Burdick | A45C 11/24 206/0.81 |
| 3,193,090 | A | 7/1965 | Hudgeons, Sr. et al. | |
| 3,199,666 | A | 8/1965 | Burdick | |
| 3,212,637 | A | 10/1965 | Shippee | |
| 3,788,464 | A | 1/1974 | Skinner | |
| 3,913,732 | A | 10/1975 | Peterson | |
| 4,063,639 | A | 12/1977 | Grant | |
| 4,270,659 | A | 6/1981 | Kuchenbecker | |
| 4,385,688 | A | 5/1983 | Grant | |
| 5,042,650 | A | 8/1991 | Mayer et al. | |
| 6,076,675 | A | 6/2000 | Pawlowski | |
| 7,100,761 | B2 * | 9/2006 | Helzer | A47F 7/02 206/0.8 |
| 8,177,057 | B1 | 5/2012 | Krull et al. | |
| 2006/0278539 | A1 | 12/2006 | Fager | |
| 2010/0084289 | A1 * | 4/2010 | Willms | B42F 5/00 206/0.84 |
| 2013/0067866 | A1 * | 3/2013 | Zacard | B65D 73/0057 53/461 |
| 2013/0228488 | A1 | 9/2013 | Wu et al. | |
| 2016/0007771 | A1 | 1/2016 | Schoeler et al. | |

FOREIGN PATENT DOCUMENTS

| | | |
|---|---|---|
| GB | 1 603 569 | 11/1981 |
| WO | WO 2004/023942 | 3/2004 |
| WO | WO 2016/007621 A1 | 1/2016 |

* cited by examiner

ROTATABLE DISPLAY

RELATED APPLICATION(S)

This application is a continuation-in-part of U.S. application Ser. No. 14/327,848, filed Jul. 10, 2014. The entire teachings of the above application(s) are incorporated herein by reference.

BACKGROUND

Coin collection displays that have sealed rotatable coin bubbles or capsules within a paperboard display can allow the coin bubble to be rotated relative to the display to align the coins for desired viewing. A drawback of such sealed rotatable coin bubbles is that the coin bubbles do not allow for the removal and replacement of coins without destroying the display or bubbles. In addition, other current coin collection displays that allow for the removal of a coin, do not allow for rotation and preferred alignment of the coin without opening the protective capsule. This is something that some coin collectors prefer not to do.

SUMMARY

The present invention can provide a display that can allow both full rotation of stored articles or coins, as well as their removal and replacement. Embodiments of the present invention can provide a rotatable display for containing an article including a coin, which can be easily rotated by a user. The rotatable display can include an article receptacle for holding the article. The article receptacle can have an outer flange. A display panel can rotatably capture the article receptacle. The display panel can include a first display layer and an annular retaining structure mounted to the first display layer rotatably capturing the outer flange of the article receptacle against the first display layer. The annular retaining structure can be deflectable against the outer flange, including annularly deflectable. The annular retaining structure can have a smooth slippery surface, and can be configured for deflecting away from the first display layer and to facilitate, or permit easier rotation of the outer flange and the article receptacle relative to the display panel.

In particular embodiments, the annular retaining structure can include a flat annular plastic washer having a thickness that is thin enough to resiliently deflect in an annular manner concentrically around an inner diameter. The display panel can further include a second display layer adhered to the first display layer. The second display layer can have a hole formed therein to form a pocket that accepts the outer flange of the article receptacle. The annular retaining structure can be mounted to the second display layer in a manner to form an annular cantilevered inner lip for annularly deflecting against the outer flange of the article receptacle. The display panel can further include a third display layer adhered over the second display layer and outer perimeter portions of the annular retaining structure. The third display layer can have a hole formed therein to further form the pocket, and can be sized to permit annular deflection of the annular cantilevered inner lip of the annular retaining structure. The display panel can further include a fourth display layer adhered over the third display layer. The fourth display layer can have a hole formed therein for closely fitting around the article receptacle and can substantially cover from view the pocket and annular retaining structure.

The first, second, third and fourth display layers can be formed of paperboard. In some embodiments, the paperboard layers can be about 0.010-0.018 inches thick, the outer flange of the article receptacle can be about 0.03-0.1 inches thick, and the annular retaining structure can be formed of PETG plastic about 0.004-0.009 inches thick. The article receptacle can be formed of a base, and a lid that is removably securable to the base. The base can have a cavity surrounded by the outer flange. The lid can be securable over the cavity. The annular retaining structure can be capturable between the outer flange of the base and the lid. The display panel can be configured for rotatably capturing more than one article receptacle.

The present invention can also provide a rotatable display for an article including an article receptacle for holding the article. The article receptacle can have a base, and a lid that is removably securable to the base. The base can have a cavity surrounded by an outer flange. A display panel can rotatably capture the article receptacle. The display panel can include paperboard layers forming a pocket for receiving the outer flange of the article receptacle, and a flat annular plastic washer rotatably capturing the outer flange against a first paperboard layer. The washer can be deflectable against the outer flange by an annular cantilevered inner lip, including annularly deflectable. The annular cantilevered inner lip of the washer can also be capturable between the outer flange of the base and the lid of the article receptacle. The washer can have a smooth slippery surface and can be configured for deflecting away from the first paperboard layer and to facilitate, or permit easier rotation of the outer flange and the article receptacle relative to the display panel.

The present invention can also provide a method of displaying an article including holding the article within an article receptacle. The article receptacle can have an outer flange. The article receptacle can be rotatably captured with a display panel. The display panel can include a first display layer and an annular retaining structure mounted to the first display layer rotatably capturing the outer flange of the article receptacle against the first display layer. The annular retaining structure can be deflectable against the outer flange, including annularly deflectable. The annular retaining structure can have a smooth slippery surface, and can be configured for deflecting away from the first display layer and to facilitate, or permit easier rotation of the outer flange and the article receptacle relative to the display panel.

In particular embodiments, the annular retaining structure can be provided as a flat annular plastic washer having a thickness that is thin enough to resiliently deflect in an annular manner concentrically around an inner diameter. The display panel can be provided with a second display layer adhered to the first display layer. The second display layer can have a hole formed therein to form a pocket that accepts the outer flange of the article receptacle. The annular retaining structure can be mounted to the second display layer in a manner to form an annular cantilevered inner lip for annularly deflecting against the outer flange of the article receptacle. The display panel can be provided with a third display layer adhered over the second display layer and outer perimeter portions of the annular retaining structure. The third display layer can have a hole formed therein to further form the pocket, and can be sized to permit annular deflection of the annual cantilevered inner lip of the annular retaining structure. The display panel can be provided with a fourth display layer adhered over the third display layer. The fourth display layer can have a hole formed therein for closely fitting around the article receptacle and substantially covering from view the pocket and annular retaining structure.

The first, second, third and fourth display layers can be provided as paperboard layers. In some embodiments, the paperboard layers can be provided with a thickness of about 0.010-0.018 inches thick, the outer flange of the article receptacle can be provided with a thickness about 0.03-0.1 inches thick, and the annular retaining structure can be formed of PETG plastic and about 0.004-0.009 inches thick. The article receptacle can be provided with a base, and a lid that is removably securable to the base. The base can have a cavity surrounded by the outer flange. The lid can be securable over the cavity. The annular retaining structure can be capturable between the outer flange of the base and lid. More than one article receptacle can be rotatably captured with the display panel.

The present invention can also provide a method of displaying an article including holding the article in an article receptacle. The article receptacle can have a base, and a lid that is removably securable to the base. The base can have a cavity surrounded by an outer flange. The article receptacle can be rotatably captured with a display panel. The display panel can include paperboard layers forming a pocket for receiving the outer flange of the article receptacle, and a flat annular plastic washer rotatably capturing the outer flange against a first paperboard layer. The washer can be deflectable against the outer flange by an annular cantilevered inner lip, including annularly deflectable. The annular cantilevered inner lip of the washer can also be capturable between the outer flange of the base and the lid of the article receptacle. The washer can have a smooth slippery surface, and can be configured for deflecting away from the first paperboard layer and to facilitate, or permit easier rotation of the outer flange and the article receptacle relative to the display panel.

The present invention can also provide a rotatable display for at least one article including at least one article receptacle for holding the at least one article. The at least one article receptacle can have an outer flange. A display panel can rotatably capture the at least one article receptacle. The display panel can include a first display layer, and at least one annular retaining structure mounted to the first display layer rotatably capturing the outer flange of the at least one article receptacle against the first display layer. The at least one annular retaining structure can have an annular cantilevered inner lip that is deflectable against the outer flange. The annular cantilevered inner lip of the at least one annular retaining structure can have a smooth slippery surface and can be configured for deflecting away from the first display layer and to facilitate rotation of the outer flange and the at least one article receptacle relative to the display panel.

In particular embodiments, the at least one annular retaining structure can each include an annular region surrounding a circular hole in a flat plastic sheet member that has a thickness that is thin enough to resiliently deflect in an annular manner concentrically around the hole. The display panel can further include a second display layer adhered to the first display layer. The second display layer can have at least one hole formed therein to form at least one pocket that accepts the outer flange of the at least one article receptacle. The plastic sheet member can be mounted to the second display layer in a manner to form the annular cantilevered inner lip of the at least one annular retaining structure for annularly deflecting against the outer flange of the at least one article receptacle. The display panel can further include a third display layer adhered over at least one of the second display layer and outer perimeter portions of the at least one annular retaining structure. The third display layer can have at least one hole formed therein to further form the at least one pocket, and can be sized to permit annular deflection of the annular cantilevered inner lip of the at least one annular retaining structure. The display panel can further include a fourth display layer adhered over the third display layer. The fourth display layer can have at least one hole formed therein for closely fitting around the at least one article receptacle and substantially covering from view said at least one pocket and the at least one annular retaining structure. The first, second, third and fourth display layers can be formed of paperboard. The paperboard layers can be about 0.010-0.018 inches thick, the outer flange of the at least one article receptacle can be about 0.03-0.1 inches thick, and the plastic sheet member can be formed of PETG plastic about 0.004-0.009 inches thick. Each of the at least one article receptacle can be formed of a base and a lid that is removably securable to the base. The base can have a cavity surrounded by the outer flange. The lid can be securable over the cavity. The at least one annular retaining structure can be capturable between the outer flange of the base and the lid. The display panel can be configured for rotatably capturing more than one article receptacle, wherein more than one circular hole can be formed in the plastic sheet member for forming more than one annular retaining structure.

The present invention can also provide a rotatable display for at least one article including at least one article receptacle for holding the at least one article. The at least one article receptacle can have a base, and a lid that is removably securable to the base. The base can have a cavity surrounded by an outer flange. A display panel can rotatably capture the at least one article receptacle. The display panel can include paperboard layers forming at least one pocket for receiving the outer flange of the at least one article receptacle. A flat plastic sheet member can have at least one circular hole with an annular region surrounding the at least one circular hole, for forming at least one annular retaining structure having an annular cantilevered inner lip rotatably capturing the outer flange against a first paperboard layer. The at least one annular retaining structure can be deflectable against the outer flange by the annular cantilevered inner lip. The annular cantilevered inner lip of the at least one annular retaining structure can also be capturable between the outer flange of the base and the lid of the at least one article receptacle. The annular cantilevered lip of the at least one annular retaining structure can have a smooth slippery surface and can be configured for deflecting away from the first paperboard layer and to facilitate rotation of the outer flange and the at least one article receptacle relative to the to the display panel.

The present invention can also provide a method of displaying at least one article including holding the at least one article within at least one article receptacle. The at least one article receptacle can have an outer flange. The at least one article receptacle can be rotatably captured with a display panel. The display panel can include a first display layer and at least one annular retaining structure mounted to the first display layer rotatably capturing the outer flange of the at least one article receptacle against the first display layer. The at least one annular retaining structure can have an annular cantilevered inner lip that is deflectable against the outer flange. The annular cantilevered lip of the at least one annular retaining structure can have a smooth slippery surface and can be configured for deflecting away from the first display layer and to facilitate rotation of the outer flange and the at least one article receptacle relative to the display panel.

In particular embodiments, each of the at least one annular retaining structure can be provided as an annular region surrounding a circular hole in a flat plastic sheet member having a thickness that is thin enough to resiliently deflect in an annular manner concentrically around the hole. The display panel can be provided with a second display layer adhered to the first display layer. The second display layer can have at least one hole formed therein to form at least one pocket that accepts the outer flange of the at least one article receptacle. The plastic sheet member can be mounted to the second display layer in a manner to form the annular cantilevered inner lip of the at least one annular retaining structure for annularly deflecting against the outer flange of the at least one article receptacle. The display panel can be provided with a third display layer adhered over at least one of the second display layer and outer perimeter portions of the at least one annular retaining structure. The third display layer can have at least one hole formed therein to further form the at least one pocket, and can be sized to permit annular deflection of the annular cantilevered inner lip of the at least one annular retaining structure. The display panel can be provided with a fourth display layer adhered over the third display layer. The fourth display layer can have at least one hole formed therein for closely fitting around the at least one article receptacle and substantially covering from view said at least one pocket and the at least one annular retaining structure. The first, second, third and fourth display layers can be provided as paperboard layers. The paperboard layers can be provided with a thickness about 0.010-0.018 inches thick, the outer flange of the at least one article receptacle can be provided with a thickness about 0.03-0.1 inches thick, and the plastic sheet member can be formed of PETG plastic about 0.004-0.009 inches thick. Each of the at least one article receptacle can be provided with a base, and a lid that is removably securable to the base. The base can have a cavity surrounded by the outer flange, and the lid can be securable over the cavity. The at least one annular retaining structure can be capturable between the outer flange of the base and the lid. More than one article receptacle can be rotatably captured with the display panel, wherein more than one circular hole can be formed in the plastic sheet member for forming more than one annular retaining structure.

The present invention can also provide a method of displaying at least one article including holding the at least one article in at least one article receptacle. The at least one article receptacle can have a base, and a lid that is removably securable to the base. The base can have a cavity surrounded by an outer flange. The at least one article receptacle can be rotatably captured with a display panel. The display panel can include paperboard layers forming at least one pocket for receiving the outer flange of the at least one article receptacle. A flat plastic sheet member having at least one circular hole with an annular region surrounding the at least one circular hole can form at least one annular retaining structure having an annular cantilevered inner lip for rotatably capturing the outer flange against a first paperboard layer. The at least one annular retaining structure can be deflectable against the outer flange by the annular cantilevered inner lip. The annular cantilevered inner lip of the at least one annular retaining structure can also be capturable between the outer flange of the base and the lid of the at least one article receptacle. The annular cantilevered lip of the at least one annular retaining structure can have a smooth slippery surface and can be configured for deflecting away from the first paperboard layer and to facilitate rotation of the outer flange and the at least one article receptacle relative to the display panel.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
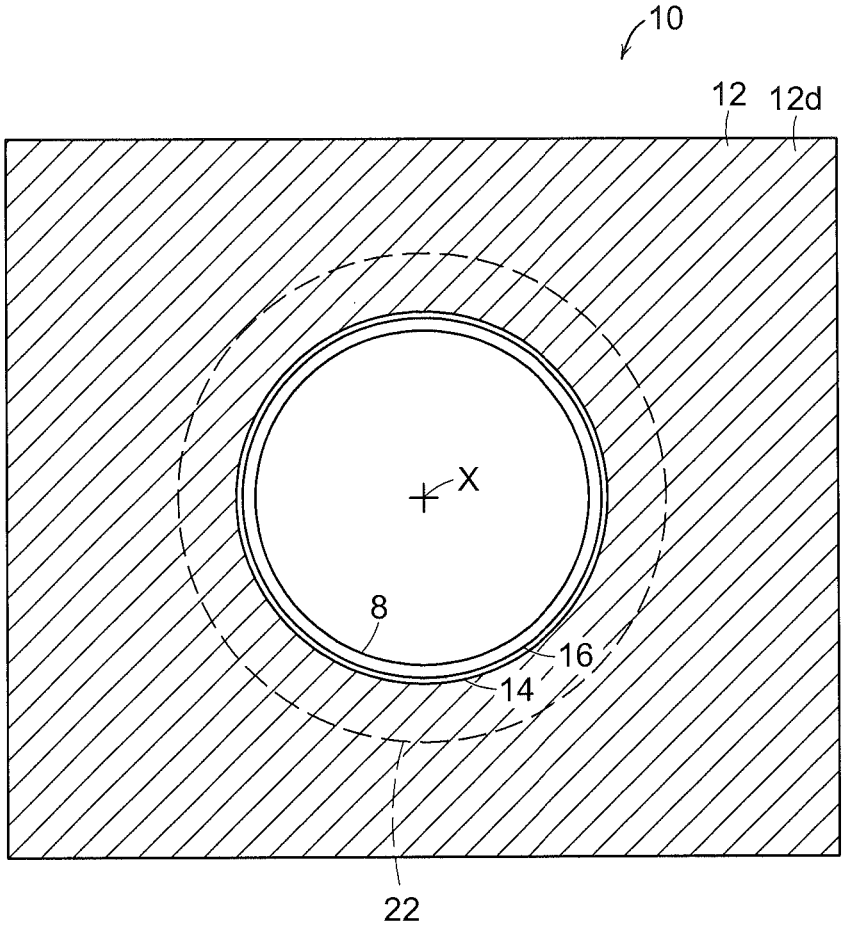
FIG. 1 is a schematic plan view of an embodiment of a rotatable display in the present invention.
Figure 2:
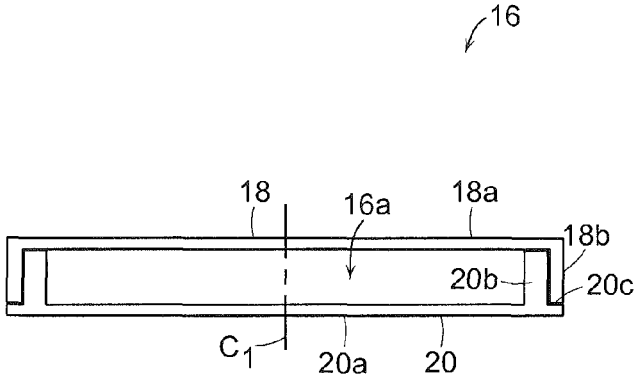
FIG. 2 is a side sectional view of an embodiment of an article receptacle.
Figure 3:
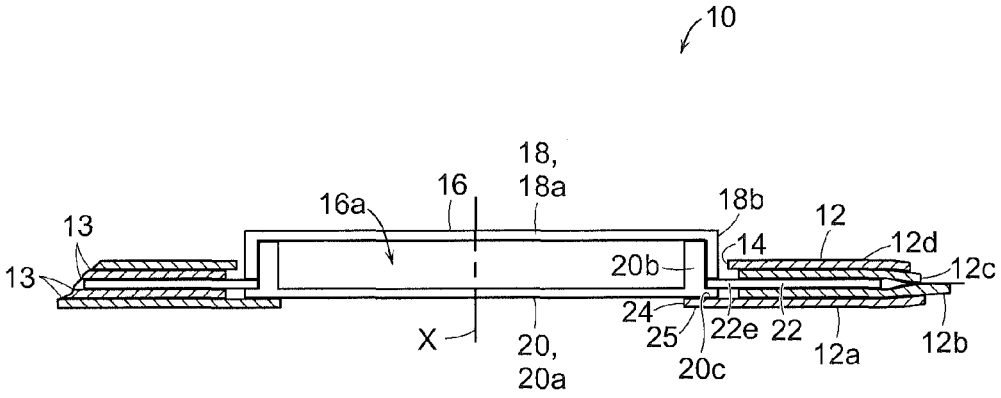
FIG. 3 is a side sectional view of a portion of the rotatable display of FIG. 1.

A description of example embodiments of the invention follows.

Referring to FIGS. 1-4, in one embodiment of the present invention, rotatable display 10 can include a display card, structure, sheet or panel 12, to which one or more article capsules, bubbles, containers, or receptacles 16, are rotatably mounted about a central axis X, for containing and displaying articles 8, such as coins, medallions, medals, or other desired collectible articles. An article 8 contained within a receptacle 16, can be oriented into a proper or desired viewing orientation by rotating the receptacle 16 relative to the display panel 12.

The receptacle 16 can be formed of a clear polymer or plastic, such as acrylic, or other suitable clear plastic, for allowing viewing of two sides of an article 8, such as a coin. The receptacle 16 can be round or circular, and can be formed of two pieces, a first, back or rear portion or base 20, and a second, top, front, forward or lid portion 18, which can be removably secured or snapped together. This can allow the insertion and removal of articles 8 into and from the cavity, hollow, cup, bowl, recess or space 16*a* within the receptacle 16. The base 20 can have a flat circular or round back or rear wall 20*a*, a circular, round or annular side wall 20*b* extending forwardly from the back wall 20*a*, and a circular, round or annular outer lip, shoulder or flange 20*c* concentrically surrounding the side wall 20*b*. The outer flange 20*c* can be a continuation along the plane of the back wall 20*a*, and extend radially outward from the side wall 20*b*. The lid 18 can have a flat circular or round top, front, forward or lid wall 18*a*, and a circular, round or annular side wall 18*b* extending rearwardly from wall 18*a* for removably engaging, securing or snapping over the side wall 20*b* of the base 20, for removable securement. The base 20 and the lid 18, along with their respective structures 20*a*, 20*b*, 20*c* and 18*a* and 18*b*, can be centered or concentric about a central axis $C_1$.

The display panel 12 can be formed of multiple layers of panels or sheets, such as paperboard. For example, the display panel 12 can have a first, back, rear or outer paperboard display layer 12*a* with a second or inner paperboard display layer 12*b*, secured, bonded or adhered to the paperboard layer 12*a*, such as by a first adhesive layer 13. A third or additional inner paperboard display layer 12*c* can be secured, bonded or adhered to paperboard layer 12*b*, such as by a second adhesive layer 13. A fourth, front or outer paperboard display layer 12*d* can be secured, bonded or adhered to the paperboard layer 12*c*, such as by a third adhesive layer 13. In some embodiments, the paperboard layers 12*a*-12*d* can be bonded together under heat and pressure, or by heat sealing. In other embodiments, cold glue or adhesive can be used, and can include adhesive coated tapes or films. In some embodiments, combinations of heat and cold sealing or adhesive processes can be used.

The outer front and back paperboard layers 12*a* and 12*d* can have graphics printed thereon, as well as protective films, coatings or layers, including UV coatings. The back paperboard layer 12*a* can have a window, aperture, opening or hole 24 concentric with axis X for viewing the rear or back side of the article 8 within receptacle 16. Holes, apertures or openings 28 and 26 can be formed within respective inner paperboard layers 12*b* and 12*c* concentric with axis X to form a recess, space, cavity or pocket 30 within panel display 12 for rotatably mounting, receiving or containing receptacle 16. A circular, round or annular retaining structure or member 22, such as a thin flat circular, round or annular resilient, flexible, bendable, elastic, deformable or deflectable plastic washer, bearing or spring, having an outer periphery or diameter 22*a* and an inner periphery or diameter hole 22*b*, concentric about a central axis $C_2$, can be bonded, adhered or secured between the two inner paperboard layers 12*b* and 12*c*, such as by adhesive layers 13, concentric with axis X. The washer 22 can resiliently rotatably retain the receptacle 16 generally concentrically within the pocket 30, by resiliently engaging, trapping or capturing the outer flange 20*c* of the base 20 of the receptacle 16. The front paperboard layer 12*d* can have a window, aperture, opening or hole 14 formed therein concentric with axis X, for allowing the receptacle 16 to extend therethrough forwardly or outwardly, allowing viewing of the front side of article 8, while at the same time substantially covering the pocket 30 and washer 22 within the display panel 12, from view of the user, for improved appearance.

Referring to FIGS. 3-6, the flat deflectable washer 22 can be very thin, for example about 0.006 inches thick, in some embodiments. As a result, the two inner paperboard layers 12*b* and 12*c* can bulge only slightly in the transition moving from outer areas where the paperboard layers 12*b* and 12*c* are bonded directly to each other, to the inner area near receptacle 16, where the washer 22 is bonded between the paperboard layers 12*b* and 12*c*, such as at the outer diameter 22*a* of washer 22. The front paperboard layer 12*d* can hide any bulges in layers 12*b* and 12*c* on the front side, and back paperboard layer 12*a* can hide any bulges on the back side. The hole 24 in the back paperboard layer 12*a* can be sized to form a thin or narrow, round, circular or annular ring 25 of paperboard for contacting and capturing the back surface 21 of the outer flange 20*c* and a small portion of the back wall 20*a* of base 20. The thin annular ring 25 of paperboard contacting the base 20 can have a radial width $W_1$ about ⅛ inches wide, in some embodiments. The inner paperboard layers 12*b* and 12*c* can have respective holes 28 and 26 formed therethrough that are larger than hole 24 in back paperboard layer 12*a*, and larger than the outer flange 20*c* of base 20. Holes 28 and 26 are sized to allow washer 22 to extend radially inwardly from the inner edges of holes 28 and 26, a sufficient amount to form a generally lateral deflectable annular cantilevered inner lip 22*e*, with the inner diameter 22*b* engaging the sidewall 20*b* and the outer flange 20*c* of the base 20. In some embodiments, the annular cantilevered inner lip 22*e* can have a radial width $W_2$ of about ⅛ inches that can be deflectable. The annular cantilevered inner lip 22*e* can extend annularly radially inwardly within annular cavity 30, with cavity portion 30*a* being below lip 22*e* and cavity portion 30*b* being above lip 22*e*. The annular cantilevered inner lip 22*e* has sufficient space to deflect frontwardly within cavity 30 in the direction of arrow A. This can resiliently rotatably trap, capture or clamp the outer flange 20*c* of the base 20 between or against the annular cantilevered inner lip 22*e* of the washer 22 and the annular ring 25 of paperboard of the back paperboard layer 12*a*. The inner diameter 22*b* of the washer 22 is sized to closely engage or capture the sidewall 20*b* of the base 20 to prevent lateral movement so that the center axis $C_1$ of the base 20 and receptacle 16 can be concentrically rotated about the central axis X and the center axis of washer $C_2$. The outer flange 20*c* of the base 20 can have back 21 and front 23 opposed surfaces for contacting the annular ring 25 of paperboard of the back paperboard layer 12*a*, and the annular cantilevered inner lip 22*e* of the washer 22. The surfaces 21 and 23 of the outer flange 20*c* can be smooth and slippery for facilitating rotation. The annular ring 25 of paperboard that contacts outer flange 20*c* can have a slippery coating formed thereon for forming a bearing surface. When the lid 18 is secured to the base 20, the sidewall 18*b* of the lid 18 can engage the front surface of the annular cantilevered inner lip 22*e* of the washer 22, axially trapping or capturing the lip 22*e* between the outer flange 20*c* of the base 20 and the sidewall 18*b* of the lid 18. However, the surface of the sidewall 18*b* contacting the lip 22*e*, as well as the surfaces of the lip 22*e* or outer flange 20*c* can be smooth and slippery, so that rotation of the receptacle 16 about axis X while being laterally and axially retained by the washer 22 and annular ring 25 of back paperboard layer 12*a* can be achieved.

The smooth slippery nature of the annular cantilevered inner lip 22*e* and the washer 22, as well as the ability of the lip 22*e* to axially deflect frontwardly concentrically around axis X in the direction of arrow A, can allow the receptacle 16 to rotate more easily than if the receptacle 16 were tightly rotatably held in place with paperboard layers. The washer 22 can provide a smooth slippery bearing surface for rotation of receptacle 16, in both the radial and thrust directions relative to axis X via inner diameter 22*b* and flat opposed surfaces 22*d*. The washer 22 can form a barrier to the adhesives used in bonding the paperboard layers 12*a*-12*d*, from contacting the outer flange 20*c* of the base 20, which could interfere with rotational ability. The washer 22 and its inner diameter 22*b* can be sized to prevent contact of the outer flange 20*c* of the base 20 and receptacle 16 with paperboard layers 12*b*-12*d*, including with holes 28, 26 and 14. The annular cantilevered inner lip 22*e* of the washer 22 can resiliently deflect forwardly in the direction of arrow A away from back paperboard layer 12*a* when the receptacle 16 is rotated, which can move the outer flange 20*c* and base 20 away from the annular ring 25 of the back paperboard layer 12*a*, and reduce the axial pressure or force that the outer flange 20*c* and the base 20 exerts on the annular ring 25 of the back paperboard layer 12*a*, which can reduce the friction force between the outer flange 20*c* and the back paperboard layer 12*a*. For example, grasping the receptacle 16 between two fingers and pushing the receptacle 16 frontward in the direction of arrow A while rotating, makes the receptacle 16 easier to rotate due to decreased friction of the outer flange 20*c* with back paperboard layer 12*a*. In contrast, pushing the receptacle 16 backward against the back paperboard layer 12*a* when rotating typically increases friction of the base 20 with the back paperboard layer 12*a* and makes the receptacle 16 more difficult to rotate. One does not need to push the receptacle 16 frontward while rotating to obtain easier rotation in comparison with a prior art capsule that is tightly held by paperboard layers. The washer 22 can be configured to normally exert lower axial pressure or friction force on the outer flange 20*c*, while capturing flange 20*c*, than in such prior art, and rotation of receptacle 16 is easier. In some embodiments, rotation of receptacle 16 can be easier then such prior art without requiring deflection of washer 22. In some embodiments, deflection of the washer 22 can be very small and virtually un-noticeable, while providing desired rotational benefits. In some embodiments, the inner paperboard layer 12*b* can have the same thickness as outer flange 20*c*, so that at rest, washer 22 can be in an undeflected state.

Figure 4:
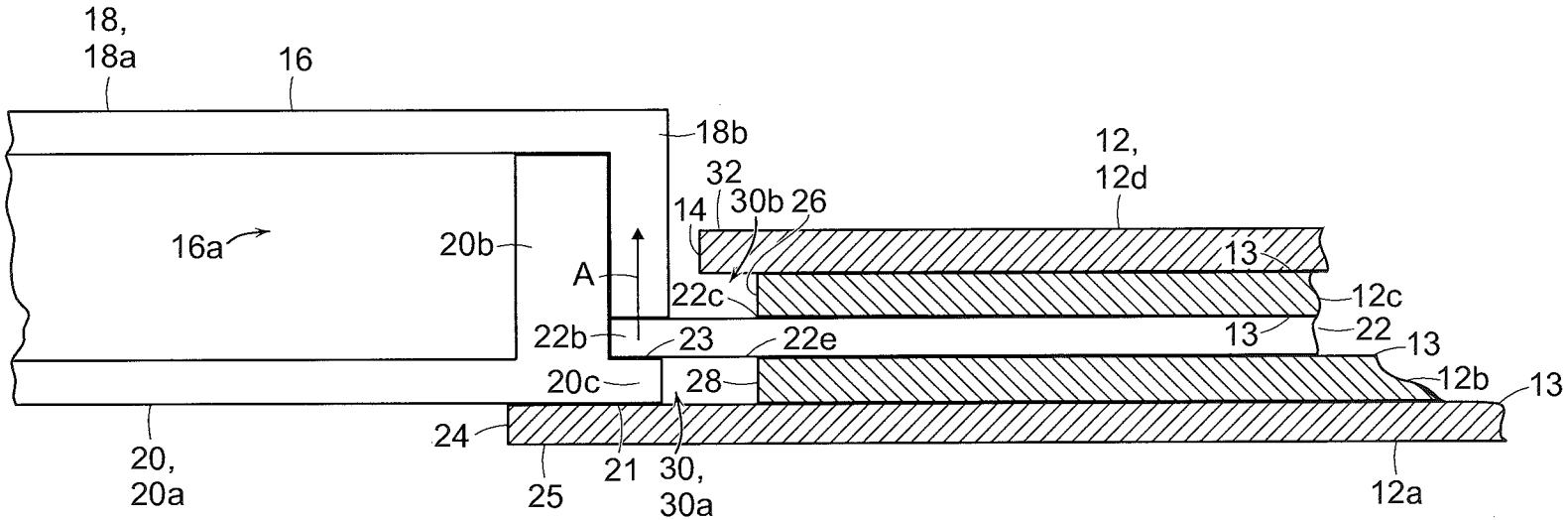
FIG. 4 is a side sectional view enlargement of a portion of FIG. 3.
Figure 5:
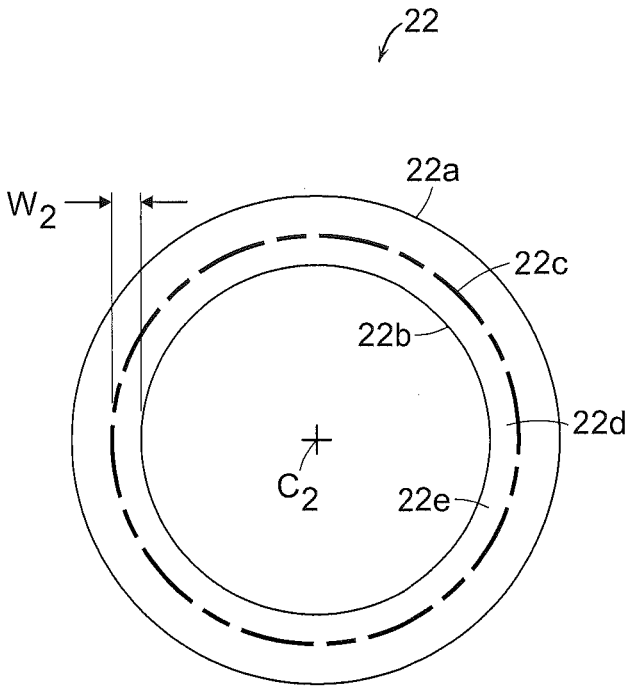
FIG. 5 is a plan view of an embodiment of an annular retaining structure.
Figure 6:
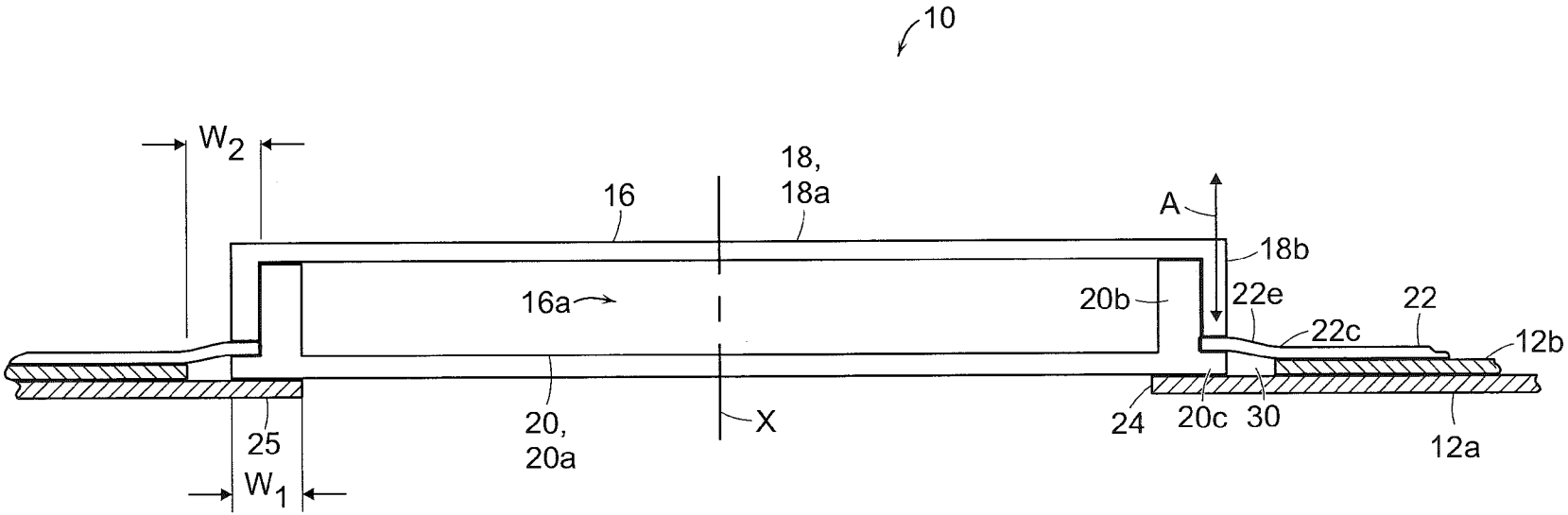
FIG. 6 is a side sectional view of an annular retaining structure deflecting against the outer flange of the article receptacle in an embodiment of the present invention.

As seen in FIGS. 4-6, the annular cantilevered inner lip 22*e* can annularly deflect along an annular, round or circular deflection line 22*c* which generally corresponds or relates to the diameter or periphery of cavity 30, formed by the diameter of holes 28 and 26 of inner paperboard layers 12*b* and 12*c*. The washer 22 can be trapped between the two inner paperboard layers 12*b* and 12*c*, and the edges of the holes 28 and 26 can provide an annular, round or circular pivot point or edge about which the lip 22*e* can annularly resiliently deform, deflect or bend. The cavity 30 can not only provide space for rotatably moving or mounting the receptacle 16, but also serves as a deflection cavity for allowing deflection of the lip 22*e* frontwardly in the direction of arrow A concentrically about axis X. The front paperboard layer 12*d* can have an annular or circular lip 32 in part formed by hole 14, extending concentrically radially inwardly over cavity 30 a substantial amount which can form a physical or mechanical stop for engaging the lip 22*e* when deflected frontwardly in the direction A, and stopping or preventing further frontward movement. This can prevent the outer flange 20*c* of the receptacle 16 from pulling, deflecting and deforming the lip 22*e* too far forwardly in the direction of arrow A, and can prevent the outer flange 20*c* and receptacle 16 from disengaging from lip 22*e*. Hole 14 can provide a large enough annular space or gap around the side wall 18*b* of the lid 18 of the receptacle 16 to allow the insertion of a fingernail for removing the lid 18, and to minimize substrate damage to at least paperboard layer 12*d*. In some embodiments, the space can range about 0.03-0.05 inches wide.

Referring to FIG. 6, in some embodiments, the outer flange 20*c* of the base 20 can be thicker than the adjacent inner paperboard layer 12*b*, so that the washer 22 is initially resiliently deflected when assembled with the base 20 to provide an initial preload bias against the front of the outer flange 20*c*, resiliently trapping, clamping or pressing the outer flange 20*c* against the annular ring 25 of the back paperboard layer 12*a*. This can prevent or reduce unwanted movement of the receptacles 16, either rotationally or in the direction of arrow A, relative to display panel 12, and can prevent or reduce unwanted rattling of the receptacles 16.

In one embodiment, the paperboard layers 12*a*-12*d* can be about 0.015 inches thick, and the outer flange 20*c* of base 20 can be about 0.05 inches thick, to provide an initial preload bias from washer 22 against outer flange 20*c*. The outer flange 20*c* can have a radial width of about 0.045 inches but can vary, for example between 0.030-0.060 inches. In other embodiments, the thickness of the layers of paperboard 12*a*-12*d* can vary for example from about 0.010-012 inches to about 0.016-0.018 inches, or even up to 0.03 inches. If desired, at least some of the paperboard layers can be impregnated with adhesive, such as on inner or internal joined surfaces of the display panel 12. In addition, the outer flange 20*c* can have a thickness from about 0.03-0.04 inches to about 0.06-0.08 inches or about 0.09 to 0.1 inches. The washer 22 can be formed of polyethylene terephthalate glycol (PETG) and can have a thickness of about 0.004-0.005 inches to about 0.007-0.009 inches. In some embodiments, the washer 22 can be formed of other suitable materials such as suitable plastics, metals, composites, etc. The receptacle 16 can be formed of acrylic, but can be formed of other suitable plastics or materials including polyethylene terephthalate glycol (PETG). The receptacle 16 can be a variety of sizes for holding various sizes of articles and such as coins or medallions. For example, the outer periphery dimensions of a receptacle 16 for holding a silver dollar can be about 1¾ inches. The outer 22*a* and inner 22*b* diameters of the washer 22 can vary in size depending upon the article 8 being held in the associated receptacle 16. For example, a silver dollar has a diameter of about 1½ inches, and a dime has a diameter of about 0.7 inches. For a washer 22 associated with a receptacle 16 for a silver dollar, embodiments of the washer 22 can have an inner diameter 22*b* around 1⅝ inches and an outer diameter 22*a* around 2½ inches. A washer 22 associated with a receptacle 16 for a dime would be of a smaller appropriate size. Although the radial width $W_1$ of the annular paperboard ring 25 of paperboard layer 12*a* and the radial width $W_2$ of the annular cantilevered inner lip 22*e* of the washer 22 can be about ⅛ inch, in other embodiments, widths $W_1$ and $W_2$ can vary, for example between about 1/16 to ¼ inch. Large widths $W_1$ of ring 25 can create more friction and make rotation more difficult. Widths $W_2$ of annular cantilevered inner lip 22*e* of washer 22 that are too small, might not deflect easily and can also make rotation more difficult. In some embodiments, some or all of the paperboard layers 12*a*-12*d* can be replaced with layers or sheets of other materials, such as with plastics, composites, wood products, metals, foils, etc.

During manufacturing, the base 20 of the receptacle 16 can be assembled with the display panel 12, and sealed under heat and pressure, or by other suitable methods, and the lids 18 can be assembled after sealing. The articles 8, such as coins can be installed later, for example by the manufacturer, or customer. The removable lid 18 allows the receptacles 16 to be opened for inspecting, removing and/or replacing the articles 8 contained therein. The four layers 12*a*-12*d* of paperboard can provide rigidity to the display panel 12 which not only is desirable for appearances, but can allow the washer 22 to operate in a predictable manner. The inner paperboard layers 12*b* and 12*c* can be adhesive impregnated in advance, or adhesive can be applied at assembly.

Figure 7:
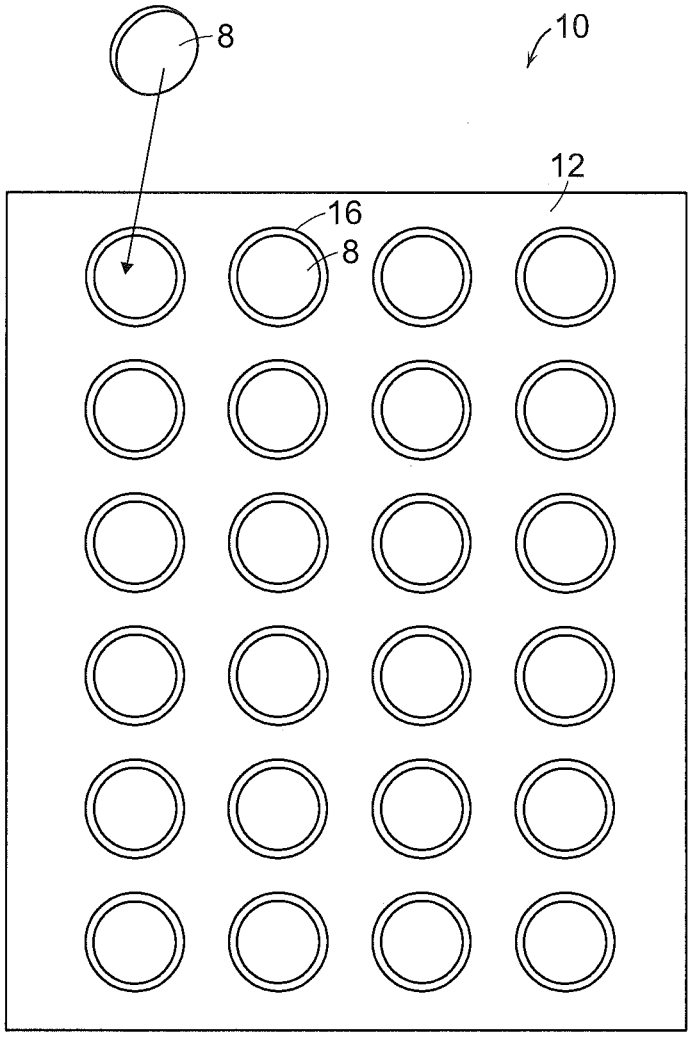
FIG. 7 is a plan view of another embodiment of a rotatable display in the present invention.

Referring to FIG. 7, embodiments of the rotatable display 10 can include a display panel 12 containing more than one or multiple rotatable receptacles 16. Although the receptacles 16 are shown to be of the same size, the sizes of the receptacles 16 can also vary, for example, to display pennies, dimes, nickels, quarters, half dollars, dollars, etc. on the same rotatable display 10. A large number of receptacles 16 such as shown in FIG. 7 can be on a large display panel 12. Smaller display panels 12 can have smaller numbers of receptacles 16. In a display panel 12 that is 8½×11 inches, the receptacles 16 can be in a 3×4 configuration to provide sufficient room between receptacles 16 to accommodate the size of the washers 22.

Figure 8:
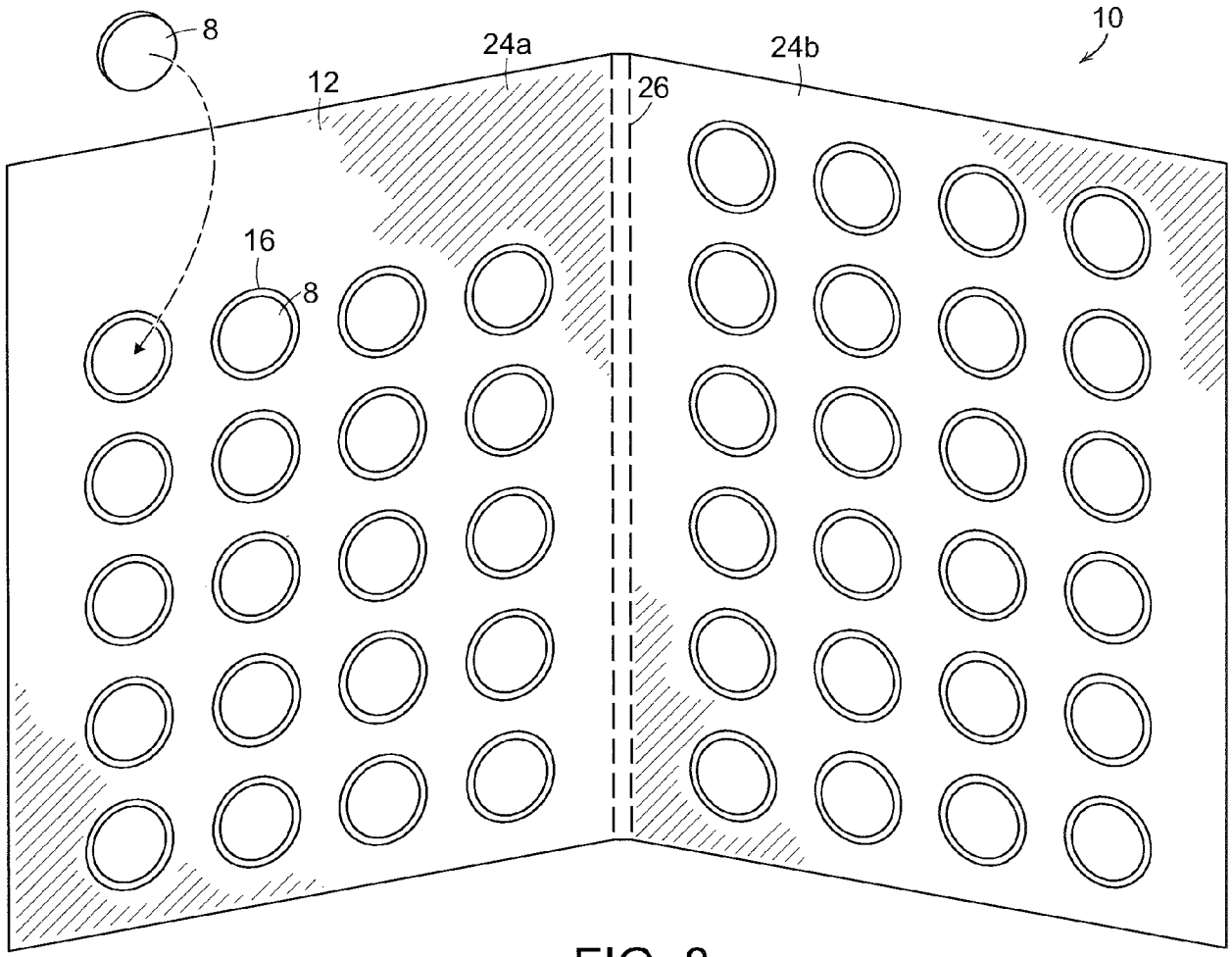
FIG. 8 is a perspective view of yet another embodiment of a rotatable display in the present invention.
Figure 9:
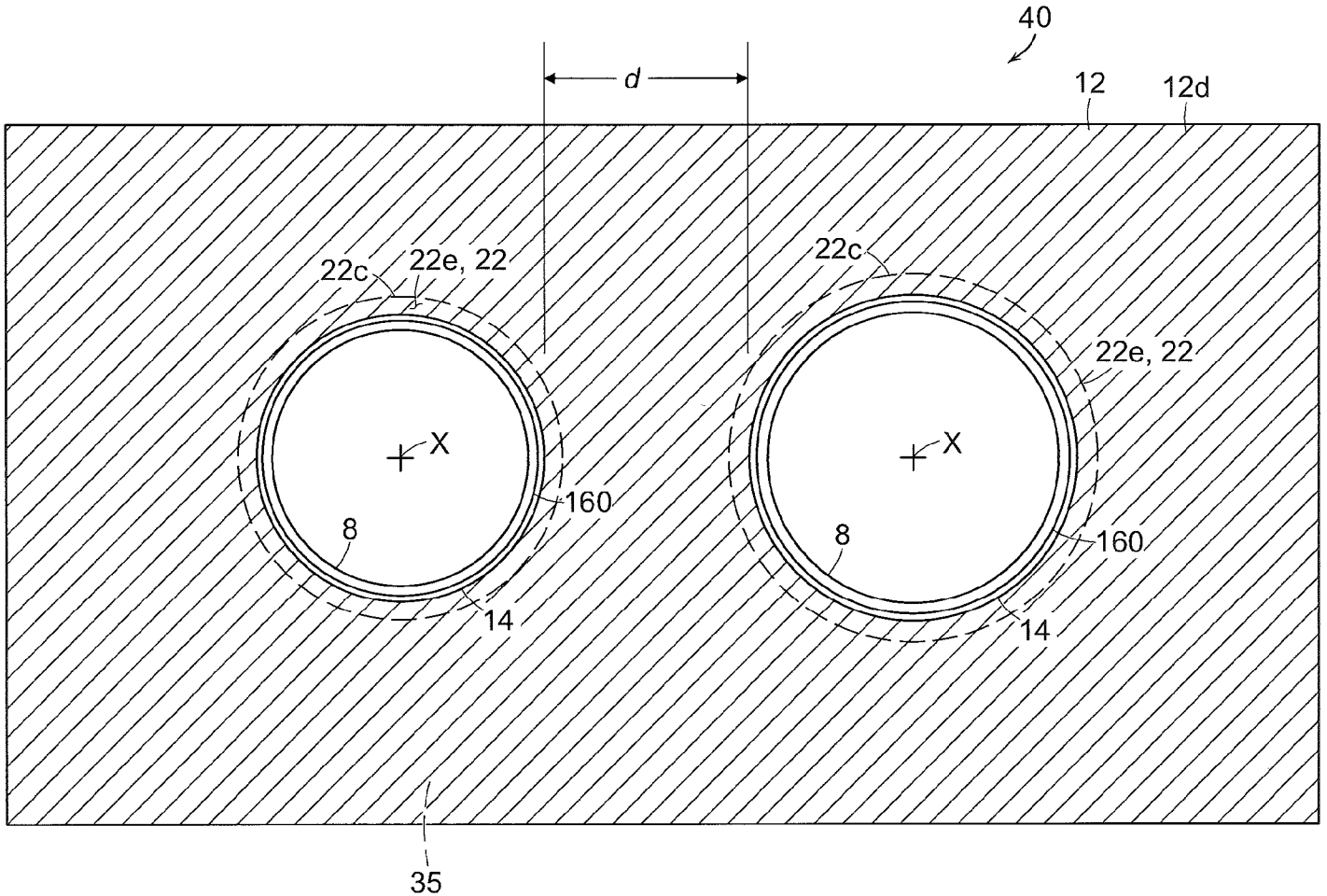
FIG. 9 is a schematic plan view of another embodiment of a rotatable display in the present invention.
Figure 10:
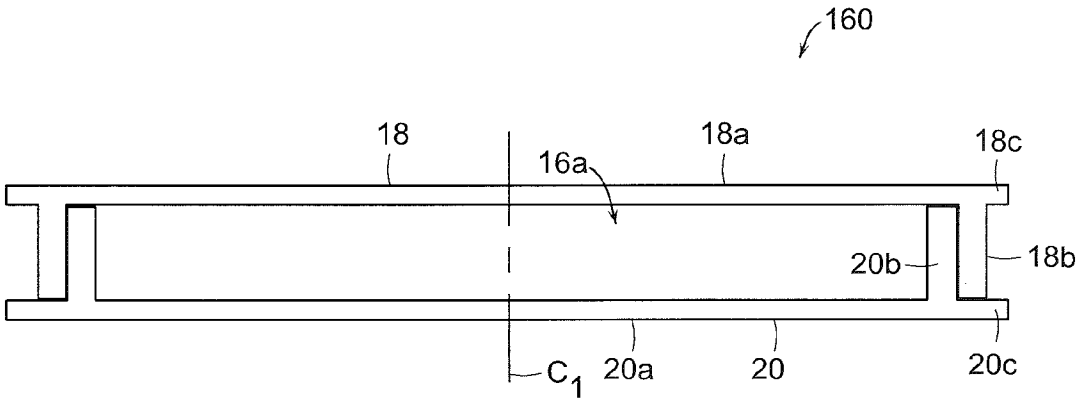
FIG. 10 is a side sectional view of another embodiment of an article receptacle.
Figure 11:
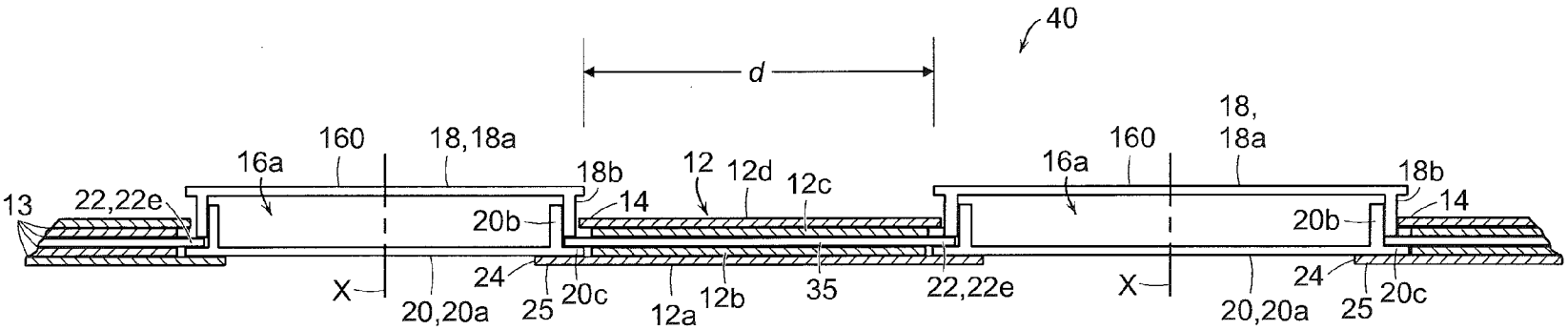
FIG. 11 is a side sectional view of a portion of the rotatable display of FIG. 9.

Referring to FIG. 8, embodiments of the rotatable display 10 can include a display panel 12 having at least two foldable leaves, panels or pages 24*a* and 24*b*, foldably connected together by a fold line 26. Although leaves 24*a* and 24*b* are both shown to include multiple receptacles 16, the number of receptacles 16 on each leaf can vary, and one leaf might not have any receptacles 16.

Referring to FIGS. 9-12, in another embodiment of the present invention, rotatable display 40 can be similar to embodiments of rotatable display 10 for rotatably mounting one or more article capsules, bubbles, containers or receptacles 160 about a respective central axis X, for containing and displaying articles 8. The receptacle 160 can be similar to receptacle 16 as described above, and differ in that the top wall 18*a* of the lid 18 can extend radially outwardly slightly beyond the side wall 18*b* to form a circular outer lid flange 18*c*. The lid flange 18*c* can allow a user to easily grip and remove the lid 18 to open the receptacle 160. The circular outer flange 20*c* of the back wall 20*a* of the base 20 can radially extend slightly beyond the side wall 18*b* of the lid 18. The flanges 18*c* and 20*c* can have a similar outer diameter and can be spaced apart from each other in a parallel manner.

The rotatable display 40 can have a display card, structure, sheet or panel 12 similar to that described above for rotatable display 10, having multiple layers, panels or sheets 12*a*-12*d*, such as paperboard, bonded together by adhesive layers 13. The display panel 12 for rotatable display 40 differs from that for rotatable display 10, in that instead of including one or more annular retaining structures 22 formed by independent, individual or separate annular washers, the one or more annular retaining structures 22 can be included in a single deflectable, flexible, or resilient flat thin plastic sheet member 35, thereby being integrally connected together, that is bonded by adhesive layers 13 between the second 12*b* and third 12*c* inner paperboard display layers. The plastic sheet member 35 can be the same size and shape, or same outer dimensions, as the layers 12*a*-12*d*, or can be smaller and have any suitable shape.

The embodiment shown in FIGS. 9-13, shows a rotatable display 40 having two receptacles 160 rotatably mounted to a display panel 12 having two annular retaining structures 22 formed in a single plastic sheet member 35. It is understood that embodiments of the rotatable display 40 can have one receptacle 160 or a number of receptacles 160.

The back paperboard layer 12*a* of display panel 12 can have holes 24 concentric with respective axes X for viewing the rear or back side of the articles 8 within receptacles 160. Holes 28 and 26 can be formed within respective inner paperboard layers 12*b* and 12*c* concentric with respective axes X to form respective pockets 30 within panel display 12 for rotatably mounting, receiving or containing respective receptacles 160. A circular, round or annular retaining structure or member 22, extending around each circular hole, opening, or aperture 34 in the flat plastic sheet member 35, can form a thin flat, planar, circular, round or annular resilient, flexible, bendable, elastic, deformable or deflectable plastic washer, ring, bearing or spring, having an inner periphery or diameter 22*b*, concentric about a respective central axis $C_2$. The plastic sheet member 35 and the retaining structures 22 can be bonded, adhered or secured between the two inner paperboard layers 12*b* and 12*c*, such as by adhesive layers 13, with each retaining structure 22 being concentric with a respective axis X. Each retaining structure 22 can resiliently rotatably retain a respective receptacle 160 generally concentrically within a pocket 30, by resiliently engaging, trapping or capturing the outer flange 20*c* of the base 20 of the respective receptacle 160. The front paperboard layer 12*d* can have holes 14 formed therein concentric with respective axes X, for allowing the receptacles 160 to extend therethrough forwardly or outwardly, allowing viewing of the front sides of articles 8, while at the same time substantially covering the pockets 30 and retaining structure 22 within the display panel 12, from view of the user.

Each hole 24 in the back paperboard layer 12*a* can be sized to form a thin or narrow, round, circular or annular ring 25 of paperboard for contacting and capturing the back surface 21 of the outer flange 20*c* and a small portion of the back wall 20*a* of base 20. The thin annular ring 25 of paperboard contacting the base 20 can have a radial width $W_1$ about ⅛ inches wide, in some embodiments. The inner paperboard layers 12*b* and 12*c* can have respective holes 28 and 26 formed therethrough that are larger than hole 24 in back paperboard layer 12*a*, and larger than the outer flange 20*c* of base 20. Holes 28 and 26 are sized to allow retaining structure 22 to extend radially inwardly from the inner edges of holes 28 and 26, a sufficient amount to form a generally flat or planar lateral deflectable annular cantilevered inner lip 22*e*, with the inner diameter 22*b* being close to or engaging the sidewall 20*b* and/or the outer flange 20*c* of the base 20. In some embodiments, the annular cantilevered inner lip 22*e* can have a radial width $W_2$ of about ⅛ inches that can be deflectable. The annular cantilevered inner lip 22*e* can extend annularly radially inwardly within annular cavity 30, with cavity portion 30*a* being below lip 22*e* and cavity portion 30*b* being above lip 22*e*. The annular cantilevered inner lip 22*e* has sufficient space to deflect frontwardly within cavity 30 in the direction of arrow A. This can resiliently rotatably trap, capture or clamp the outer flange 20*c* of the base 20 between or against the annular cantilevered inner lip 22*e* of the retaining structure 22 and the annular ring 25 of paperboard of the back paperboard layer 12*a*. The inner diameter 22*b* of the retaining structure 22 is sized to be close or closely engage or capture the sidewall 20*b* of the base 20 to prevent lateral movement so that the center axis $C_1$ of the base 20 and receptacle 160 can be concentrically rotated about the central axis X and the center axis of the retaining structure $C_2$. The outer flange 20*c* of the base 20 can have back 21 and front 23 opposed surfaces for contacting the annular ring 25 of paperboard of the back paperboard layer 12*a*, and the annular cantilevered inner lip 22*e* of the retaining structure 22. The surfaces 21 and 23 of the outer flange 20*c* can be smooth and slippery for facilitating rotation. The annular ring 25 of paperboard that contacts outer flange 20*c* can have a slippery coating formed thereon for forming a bearing surface. When the lid 18 is secured to the base 20, the sidewall 18*b* of the lid 18 can engage the front surface of the annular cantilevered inner lip 22*e* of the retaining structure 22, axially trapping or capturing the lip 22*e* between the outer flange 20*c* of the base 20 and the sidewall 18*b* of the lid 18, while still allowing rotation. The annular cantilevered inner lip 22*e* of the retaining structure 22 can operate in a similar manner as described for rotatable display 10.

Figure 12:
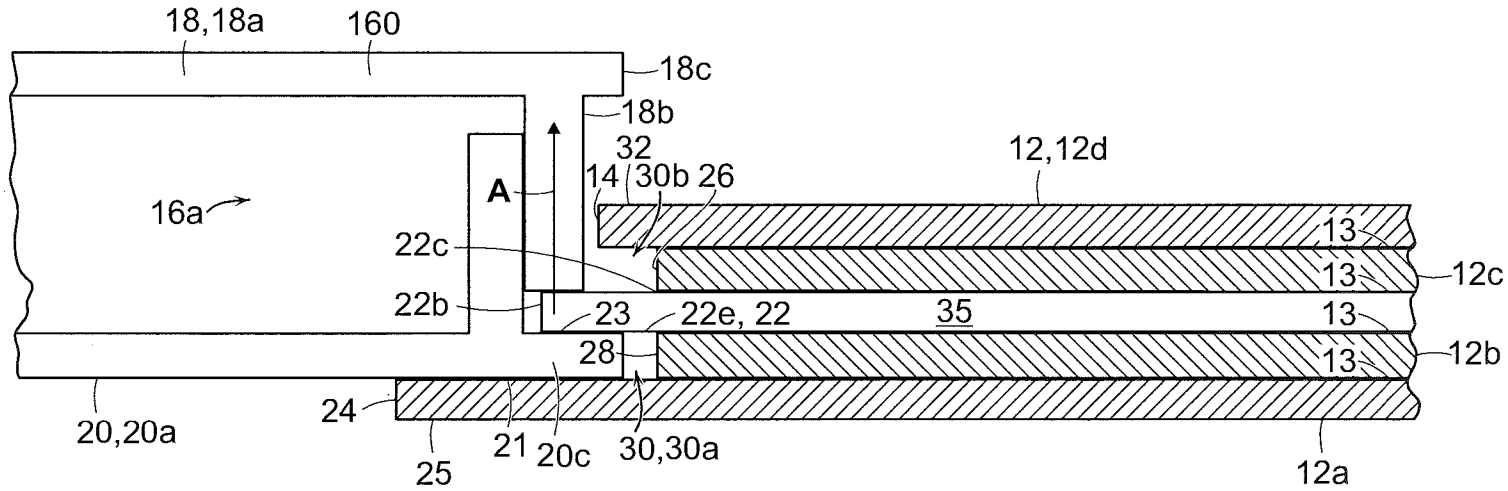
FIG. 12 is a side sectional view enlargement of a portion of FIG. 11.
Figure 13:
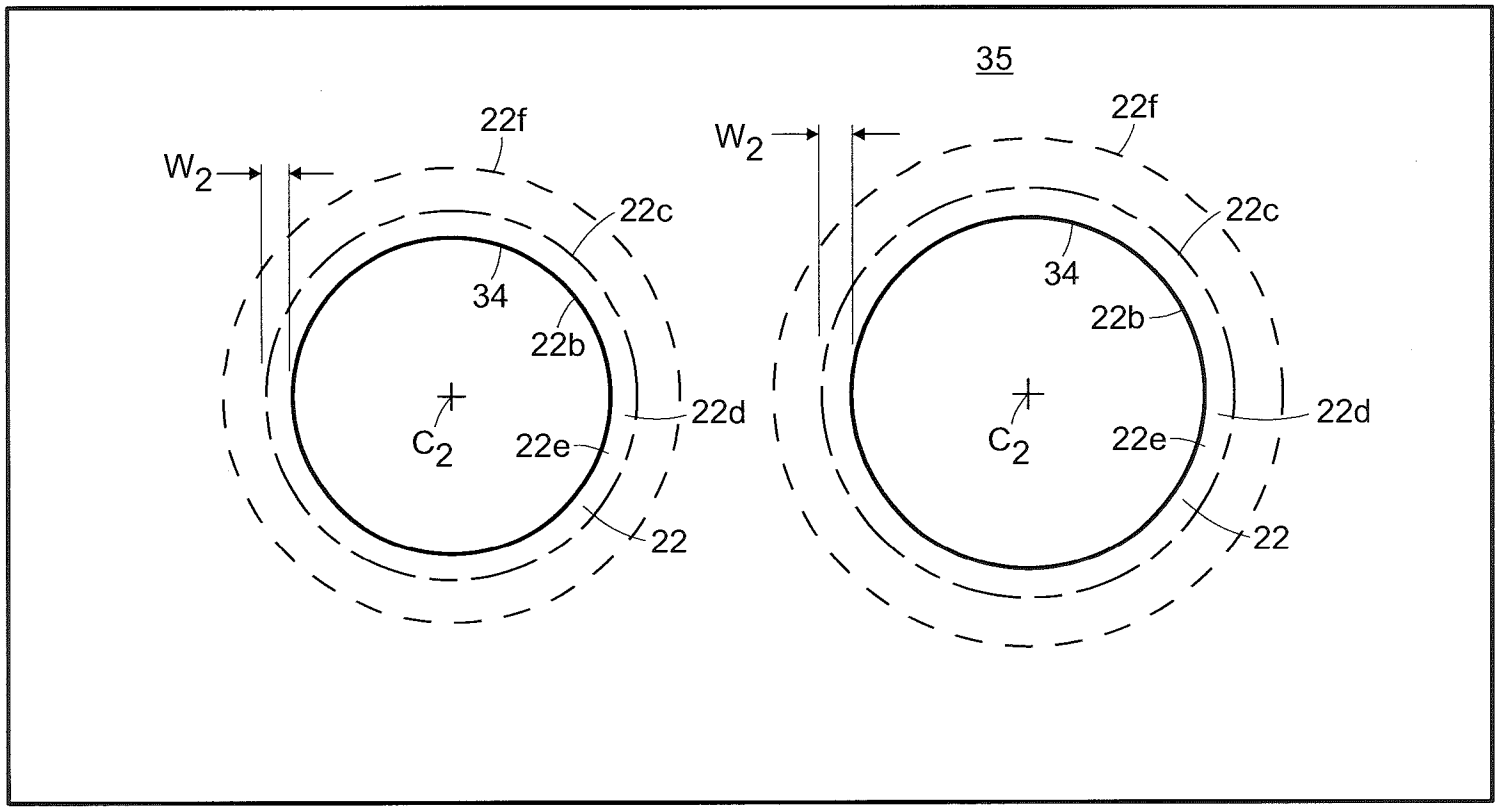
FIG. 13 is a plan view of an embodiment of a plastic sheet member with multiple annular retaining structures.

As seen in FIGS. 12-13, each annular cantilevered inner lip 22*e* can annularly deflect along an annular, round or circular deflection line 22*c* which generally corresponds or relates to the diameter or periphery of a respective cavity 30, formed by the diameter of holes 28 and 26 of inner paperboard layers 12*b* and 12*c*. The plastic sheet member 35 can be trapped between at least portions of the two inner paperboard layers 22*b* and 22*c*, and the edges of the holes 28 and 26 can provide an annular, round or circular pivot point or edge about which the lip 22*e* can annularly resiliently deform, deflect or bend. Each cavity 30 can not only provide space for rotatably moving or mounting the respective receptacle 160, but also serves as a deflection cavity for allowing deflection of the lip 22*e* frontwardly in the direction of arrow A concentrically about axis X. The front paperboard layer 12*d* can have an annular or circular lip 32 in part formed by hole each 14, extending concentrically radially inwardly over cavity 30 a substantial amount which can form a physical or mechanical stop for engaging the lip 22*e* when deflected frontwardly in the direction A, and stopping or preventing further frontward movement.

The flat thin plastic sheet member 35 can be formed of the same material and be of the same thickness as the washer in rotatable display 10. Each hole 34 can be formed in sheet member 35 by die cutting, or by other suitable means known in the art, providing the inner periphery 22*b* of the retaining structure 22 about a respective central axis $C_2$ for alignment with a respective axis X. Each retaining structure 22 can include flat or planar integral regions or portions of the sheet member 35 extending concentrically radially outward from, surrounding and around the inner periphery 22*b* of hole 34. This can include the annular cantilevered inner lip 22*e* defined by the circular deflection line 22*c* corresponding to the periphery of cavity 30, and can also include a portion or area of the sheet member 35 extending radially outward from, surrounding and around the circular deflection line 22*c*, such as indicated by concentric circular annular area, region or portion 22*f*, which can be trapped and secured between paperboard layers 12*b* and 12*c*. The trapped portion 22*f* provides the annular cantilevered inner lip 22*e* with fixed attachment or securement, which allows the annular cantilevered inner lip 22*e* to annularly deflect about the circular or annular pivot point or edge formed by the edges of holes 28 and 26. Although portion 22*f* is shown to have a circular outer periphery, the outer extent of portion 22*f* does not have to be round, and does not have to have a fixed width, but should be wide or big enough to provide fixed securement of the annular cantilevered inner lip 22*e*. Portion 22*f* can be considered in some embodiments to be about 1/16-1/8, or up to 1/4 inches wide, and can overlap with neighboring portions 22*f*. The portions of the flat or planar sheet member 35 surrounding each circular deflection line 22*c* or portion 22*f* can integrally connect or interconnect the retaining structures 22 together along a flat plane of the sheet member 35.

Forming multiple retaining structures 22 within a common or single sheet member 35 can allow the receptacles 160 in rotatable display 40 to be positioned closer together than the receptacles 16 in rotatable display 10. For example, the receptacles 160 can be positioned apart from each other a distance that is about 1/2 inch or even less. In some embodiments the outer flanges 20*c* of the receptacles 160 can be positioned about 1/4 inch apart. The receptacles 160 can be of the same size, or can be of differing sizes as shown, for example, for containing different sized coins. Multiple holes 34 forming retaining structures 22 can be formed in a single sheet member 35 in desired patterns or arrangements. In some embodiments, more than one sheet member 35 can be used in rotatable display 40, and can include the same or differing retaining structure patterns. Rotatable display 40 can include configurations or patterns similar to those shown in FIGS. 1, 7 and 8, and can also include other suitable arrangements or patterns, including geometric, circular, semicircular or arched patterns. In some embodiments, holes 34 in sheet member 35 do not have to be circular, but can be oval or have curved arcs, forming retaining structures 22 with deflectable noncircular cantilevered inner lips or flanges. Holes 34 can also be polygonal, such as triangular, square, hexagonal, octagonal, etc., or can have a series of flanges formed by tabs. In some embodiments, the sheet member 35 can be formed of other suitable materials, which can include composites or thin metallic sheets.

While this invention has been particularly shown and described with references to example embodiments thereof, it will be understood by those skilled in the art that various changes in form and details may be made therein without departing from the scope of the invention encompassed by the appended claims.

It is understood that various features described or shown can be omitted or combined together. Although particular dimensions have been given, it is understood that dimensions can vary, depending upon the situation at hand. In addition, although directional terms have been used, such as front, back, etc., it is understood that this does not limit the orientation of the rotatable displays 10 and 40 or their elements. It is also understood that the receptacles 16 and 160 do not have to be round, but can have other suitable shapes for containing desired articles. Archival quality materials can be used for the components of the present invention, but comparable materials can be used in some embodiments if archival quality is not a requirement for containment of articles 8.

What is claimed is:

1. A rotatable display for at least one article comprising:

at least one article receptacle for holding the at least one article, the at least one article receptacle having an outer flange; and a display panel for rotatably capturing the at least one article receptacle, the display panel comprising a first display layer and a second display layer adhered to the first display layer, at least one annular retaining structure mounted to the second display layer, and a third display layer adhered over at least one of the second display layer and outer perimeter portions of the at least one annular retaining structure, the second and third display layers each having at least one hole therethrough that are larger than the outer flange of the at least one article receptacle forming at least one pocket accepting the at least one article receptacle and forming at least one annular cavity spaced apart from and surrounding the outer flange of the at least one article receptacle above and below the at least one annular retaining structure, the at least one annular retaining structure extending annularly radially inwardly within the at least one annular cavity from between the second and third display layers to form an annular cantilevered lip for rotatably capturing the outer flange of the at least one article receptacle against the first display layer, the annular cantilevered lip of the at least one annular retaining structure being deflectable against the outer flange of the at least one article receptacle within the at least one annular cavity, the annular cantilevered inner lip of the at least one annular retaining structure having a smooth slippery surface and configured for deflecting away from the first display layer and to facilitate rotation of the outer flange and the at least one article receptacle relative to the display panel.

2. The rotatable display of claim 1 in which the at least one annular retaining structure comprises an annular region surrounding a circular hole in a flat plastic sheet member having a thickness that is thin enough to resiliently deflect in an annular manner concentrically around the hole.

3. The rotatable display of claim 1 in which the display panel further comprises a fourth display layer adhered over the third display layer, the fourth display layer having at least one hole formed therein for closely fitting around the at least one article receptacle and substantially covering from view said at least one pocket and the at least one annular retaining structure.

4. The rotatable display of claim 3 in which the first, second, third and fourth display layers are formed of paperboard.

5. The rotatable display of claim 4 in which the paperboard layers are about 0.010-0.018 inches thick, the outer flange of the at least one article receptacle is about 0.03-0.1 inches thick, and the plastic sheet member is formed of PETG plastic about 0.004-0.009 inches thick.

6. The rotatable display of claim 1 in which each of the at least one article receptacle is formed of a base and a lid that is removably securable to the base, the base having a cavity surrounded by the outer flange, and the lid securable over the cavity, the at least one annular retaining structure being capturable between the outer flange of the base and the lid.

7. The rotatable display of claim 2 in which the display panel is configured for rotatably capturing more than one article receptacle, wherein more than one circular hole is formed in the plastic sheet member for forming more than one annular retaining structure.

8. A rotatable display for at least one article comprising:

at least one article receptacle for holding the at least one article, the at least one article receptacle having a base, and a lid that is removably securable to the base, the base having a cavity surrounded by an outer flange; and a display panel for rotatably capturing the at least one article receptacle, the display panel comprising paperboard layers forming at least one pocket for receiving the at least one article receptacle and forming at least one annular cavity spaced apart from and surrounding the outer flange of the at least one article receptacle above and below a flat plastic sheet member mounted between two paperboard layers, the flat plastic sheet member having at least one circular hole with an annular region surrounding the at least one circular hole forming at least one annular retaining structure having an annular cantilevered inner lip extending annularly radially inwardly within the at least one annular cavity from between said two paperboard layers for rotatably capturing the outer flange of the at least one article receptacle against a first paperboard layer, the annular cantilevered lip of the at least one annular retaining structure being deflectable against the outer flange of the at least one article receptacle within the at least one annular cavity, the annular cantilevered inner lip of the at least one annular retaining structure also being capturable between the outer flange of the base and the lid of the at least one article receptacle, the annular cantilevered lip of the at least one annular retaining structure having a smooth slippery surface and configured for deflecting away from the first paperboard layer and to facilitate rotation of the outer flange and the at least one article receptacle relative to the display panel.

9. A rotatable display for at least one article comprising:

at least one article receptacle for holding the at least one article, the at least one article receptacle having an outer flange; and a display panel for rotatably capturing the at least one article receptacle, the display panel comprising a first display layer and a second display layer secured to the first display layer, at least one flange retaining structure mounted to the second display layer, and a third display layer secured over at least one of the second display layer and outer portions of the at least one flange retaining structure, the second and third display layers each having at least one hole therethrough that are larger than the outer flange of the at least one article receptacle forming at least one pocket accepting the at least one article receptacle and forming at least one cavity spaced apart from and surrounding the outer flange of the at least one article receptacle above and below the at least one flange retaining structure, the at least one flange retaining structure extending inwardly within the at least one cavity from between the second and third display layers to form a cantilevered lip for rotatably capturing the outer flange of the at least one article receptacle against the first display layer, the cantilevered lip of the at least one flange retaining structure being deflectable against the outer flange of the at least one article receptacle within the at least one cavity.

* * * * *